US008428949B2

(12) United States Patent
Neoran et al.

(10) Patent No.: US 8,428,949 B2
(45) Date of Patent: Apr. 23, 2013

(54) APPARATUS AND METHOD FOR CLASSIFICATION AND SEGMENTATION OF AUDIO CONTENT, BASED ON THE AUDIO SIGNAL

(75) Inventors: Itai Neoran, Beit-Hannanya (IL); Yizhar Lavner, Merom Hagalil (IL); Dima Ruinskiy, Zefat (IL)

(73) Assignee: Waves Audio Ltd., Tel Aviv (IL)

( * ) Notice: Subject to any disclaimer, the term of this patent is extended or adjusted under 35 U.S.C. 154(b) by 967 days.

(21) Appl. No.: 12/495,171

(22) Filed: Jun. 30, 2009

(65) Prior Publication Data

US 2010/0004926 A1 Jan. 7, 2010

Related U.S. Application Data

(60) Provisional application No. 61/129,469, filed on Jun. 30, 2008.

(51) Int. Cl.
*G10L 21/00* (2006.01)

(52) U.S. Cl.
USPC ..... 704/253; 704/254; 381/28

(58) Field of Classification Search ..... 704/253, 704/254; 381/28
See application file for complete search history.

(56) References Cited

U.S. PATENT DOCUMENTS

| | | | | |
|---|---|---|---|---|
| 6,901,362 | B1 | 5/2005 | Jiang et al. | |
| 8,015,005 | B2 * | 9/2011 | Ma | 704/236 |
| 2003/0182118 | A1 * | 9/2003 | Obrador et al. | 704/246 |
| 2004/0170392 | A1 * | 9/2004 | Lu et al. | 386/96 |
| 2004/0210436 | A1 | 10/2004 | Jiang et al. | |
| 2006/0133624 | A1 * | 6/2006 | Waserblat et al. | 381/119 |
| 2006/0212295 | A1 | 9/2006 | Wasserblat et al. | |
| 2009/0006102 | A1 | 1/2009 | Kan et al. | |
| 2009/0210226 | A1 * | 8/2009 | Ma | 704/236 |

OTHER PUBLICATIONS

International Search Report dated Oct. 13, 2009 in counterpart International Application No. PCT/IL2009/000654.

Written Opinion of the International Searching Authority dated Oct. 13, 2009 in counterpart International Application No. PCT/IL2009/000654.

Ajmera et al; "Speech/Music Segmentation Using Entropy and Dynamism Features in a HMM Classification Framework;" *Speech Communication*; 2003; pp. 351-363; vol. 40; Elsevier Publishing.

Scheirer et al; "Construction and Evaluation of a Robust Multifeature Speech/Music Discriminator;" *Proceedings of the Proc. IEEE International Conference on Acoustic Speech and Signal Processing*; 1997; Munich, Germany.

(Continued)

*Primary Examiner* — Daniel D Abebe
(74) *Attorney, Agent, or Firm* — Oliff & Berridge, PLC

(57) ABSTRACT

An apparatus for classifying an input audio signal into audio contents of a first and second class, comprising an audio segmentation module adapted to segment said input audio signal into segments of a predetermined length; a feature computation module adapted to calculate for the segments features characterizing said audio input signal; a threshold comparison module adapted to generate a feature vector for each of said one or more segments based on a plurality of predetermined thresholds, the thresholds including for each of the audio contents of the first class and of the second class a substantially near certainty threshold, a substantially high certainty threshold, and a substantially low certainty threshold; and a classification module adapted to analyze the feature vector and classify each one of said one or more segments as audio contents of the first class, of the second class, or as non-decisive audio contents.

18 Claims, 8 Drawing Sheets

OTHER PUBLICATIONS

Davis et al; "Comparison of Parametric Representations for Monosyllabic Word Recognition in Continuously Spoken Sentences;" *IEEE Transactions on Acoustics, Speech and Signal Processing*; Aug. 1980; pp. 357-367; vol. ASSP-28, No. 4.
Stevens et al; "The Relation of Pitch to Frequency: A Revised Scale;" *The American Journal of Psychology*; Jul. 1940; pp. 329-353; vol. 53, No. 3.
Lu et al; "Content Analysis for Audio Classification and Segmentation;" *IEEE Transactions on Speech and Audio Processing*; Oct. 2002; pp. 504-516; vol. 10, No. 7.
Burred et al; "Hierarchal Automatic Audio Signal Classification;" *Journal of Audio English Sociology*; Jul./Aug. 2004; pp. 724-739; vol. 52, No. 7/8.
Quatieri; "Discrete-Time Speech Signal Processing;" Prentice Hall; 2001; pp. 712-717.
Theodoridis et al; "Pattern Recognition;" 2nd ed. Academic Press; 2001; pp. 175-186.
Lavner et al; "A Decision-Tree-Based Algorithm for Speech/Music Classification and Segmentation;" *Journal on Audio. Speech, and Music Processing*; 2009; pp. 1-14; vol. 2009, Article ID 239892; Hindavi Publishing Corporation.
Djurovic et al; "Special Issue on Robust Processing of Nonstationary Signals;" *EURASIP Journal on Advances in Signal Processing*; To be published Jul. 1, 2010.
Han et al; "Special Issue on Video Analysis, Abstraction, and Retrieval: Techniques and Applications;" *International Journal of Digital Multimedia Broadcasting*; To be published Mar. 1, 2010.
Xin et al; "Special Issue on Interference Management in Wireless Communication Systems: Theory and Applications;" *EURASIP Journal on Wireless Communications and Networking*; To be published Jun. 1, 2010.
The International Dialects of English Archive (www.ku.edu/~idea/), 1 sheet, Jun. 29, 2009.
The World Voices Collection (www.world-voices.com/), 6 sheets, Jun. 29, 2009.
The Indian Institute of Scientific Heritage (www.iish.org), 1 sheet, Jun. 29, 2009.

* cited by examiner

APPARATUS AND METHOD FOR CLASSIFICATION AND SEGMENTATION OF AUDIO CONTENT, BASED ON THE AUDIO SIGNAL

CROSS-REFERENCE(S) TO RELATED APPLICATION(S)

This application claims the benefit of U.S. Provisional Application No. 61/129,469, filed 30 Jun. 2008; the disclosure of which is incorporated herein by reference in its entirety.

FIELD OF INVENTION

The invention relates to audio signal processing and, in particular, to audio contents classification.

BACKGROUND OF INVENTION

In the past decade relatively large amounts of multimedia data such as text, images, video, and audio, have become available. Efficient organization and manipulation of this data is frequently required for many tasks, such as for example, data classification for storage or navigation purposes, differential processing based on content, searching for specific information, among others.

A substantial portion of the data is audio originating from sources such as broadcasting channels, databases, Internet streams, commercial CDs, and the like. Responsive to a fast-growing demand for handling of the data, a relatively new field of research known as audio content analysis (ACA), or machine listening, has recently emerged. With ACA, it is possible to analyze the audio data and extract content information directly from the acoustic signal, to the point of creating a "Table of Contents" of the audio data.

Audio data (for example from broadcasting) often contains alternating portions of different types or classes of audio contents, such as for example speech and music. Generally, one of the fundamental tasks in manipulating such data is speech/music classification and segmentation, which is often a first step in processing the data. Such preprocessing may be desirable for applications requiring, for example, accurate demarcation of speech such as in automatic transcription of broadcast news, speech and speaker recognition, word or phrase spotting, and the like. Similarly, it is useful in applications involving classification of music types, for example, such as genre-based or mood-based classification. Audio content classification may also be of importance for use in applications that apply differential processing to audio data, such as content-based audio coding and compressing, or automatic equalization of speech and music. In a further example, audio content classification can also serve for indexing other data, for example, classification of video content through the accompanying audio.

One of the challenges in speech/music classification is characterization of the music signal. Speech is generally characterized by a group of relatively characteristic and well-defined sounds and as such, may be represented by relatively non-complex models. On the other hand, the assortment of sounds in music is much broader and less definite. Music can represent sounds produced by a variety of instruments, and frequently, produced by many sources simultaneously. As such, devising a model to accurately represent and encompass all kinds of music is relatively complex and may be difficult to achieve. Furthermore, the music may include superimposed speech (or speech may include superimposed music), making the model even more complex. As a result, many of the algorithmic solutions developed for speech/music classification are usually adapted to a specific application intended to be served.

The topic of audio content classification has been studied in the past. While the applications of audio content classification may be different, many studies use similar sets of acoustic features, such as short time energy, zero-crossing rate, cepstrum coefficients, spectral roll-off spectrum centroid and "loudness", alongside some unique features, such as "dynamism". However, an exact combination of features used can vary greatly, as well as a size of the feature set. Different studies propose various classification algorithms, even though some popular classifiers (K-nearest neighbor, Gaussian multivariate, neural network) are often used as a basis. Furthermore, in many studies, different databases are used for training and for testing the algorithm, the training and testing databases generally being relatively small.

U.S. Pat. No. 6,901,362, "Audio Segmentation and Classification", describes "A portion of an audio signal is separated into multiple frames from which one or more different features are extracted. These different features are used, in combination with a set of rules, to classify the portion of the audio signal into one of multiple different classifications (for example, speech, non-speech, music, environment sound, silence, etc.). In one embodiment, these different features include one or more of line spectrum pairs (LSPs), a noise frame ratio, periodicity of particular bands, spectrum flux features, and energy distribution in one or more of the bands. The line spectrum pairs are also optionally used to segment the audio signal, identifying audio classification changes as well as speaker changes when the audio signal is speech."

US Patent Application Publication No. 2009/0006102, "Effective Audio Segmentation and Classification", describes "A method (400) and system (200) for classifying an audio signal. The method (400) operates by first receiving a sequence of audio frame feature data, each of the frame feature data characterising an audio frame along the audio segment. In response to receipt of each of the audio frame feature data, statistical data characterising the audio segment is updated with the received frame feature data. The received frame feature data is then discarded. A preliminary classification for the audio segment may be determined from the statistical data. Upon receipt of a notification of an end boundary of the audio segment, the audio segment is classified (410) based on the statistical data."

SUMMARY OF THE INVENTION

An aspect of some embodiments of the invention relates to an apparatus, system and a method for classifying and/or segmenting audio content in audio signals into a first audio content type (first class, class 1) and a second audio content type (second class, class 2). The first audio content type may be speech and the second audio content type may be music. The apparatus may be used in consumer audio applications, where various real-time differential enhancements may be applied. Optionally, the apparatus may be used for classifying and/or segmenting audio content into types not necessarily limited to speech and/or music. These may include, for example, environmental sound and silence. Optionally, the audio content types may include any combination of the above mentioned types. Additionally or alternatively, the apparatus may be readily adapted to different audio types, and may be suitable for real-time operation.

In accordance with an aspect of an embodiment of the invention, classification and/or segmentation of the audio content by the apparatus includes obtaining an input audio signal; dividing the signal into one or more audio segments; classifying each segment of the audio signal, for example, using a multi-stage sieve-like approach and applying Bayesian and/or rule-based methods; and optionally smoothing the classification decision for each segment using past segment decisions. The multi-stage sieve-like approach includes generating a feature vector for each segment from a pre-defined set of features, and comparing the feature vector with thresholds based on predetermined feature values (feature thresholds or thresholds), to classify each segment in the one or more segments into the first or the second class. Optionally the feature vector may be generated for several segments. Additionally or alternatively, the feature vector may be generated for one or more continuous frames in the segment. The features include short-time energy, zero-crossing rate, band energy ratio, autocorrelation coefficient, Mel frequency cepstrum coefficients, spectrum roll-off point, spectrum centroid, spectral flux, spectrum spread, or any combination thereof.

In some embodiments, the thresholds, for example comprising 5 for each feature, are based on probability density functions estimated for each feature from varied audio content types accumulated over a period of time. The thresholds include a substantially near certain threshold for the first class and a substantially near certain threshold for the second class, indicative of a measure of certainty of essentially 100% when a feature reaches or exceeds one of the thresholds; a substantially high certainty threshold for the first class and a substantially high certainty threshold for the second class, indicative of a measure of certainty of a high probability (for example, in any one of the following ranges; 37%-100%, 50%-100%, 65%-100%) when a feature reaches or exceeds one of the thresholds; and a substantially low certainty threshold for both the first class and the second class, indicative of a measure of certainty of a lower probability (for example, in any one of the following ranges; less than 37%, less than 50%, less than 65%) for features below the substantially high certainty thresholds. Optionally, the thresholds may be heuristically determined. Optionally, the thresholds may be non-statistically determined.

In an initial classification stage, a decision is made by comparing the feature vector with the feature thresholds, with respect to those segments for which a measure of certainty related to their classification is indicative of at least one of the features reaching or surpassing the substantially near certainty threshold for the first (second) class, while for all other features the measure of certainty related to their classification is indicative for the class of no features reaching or surpassing the substantially near certainty threshold nor the substantially high certainty threshold of the second class. For convenience, the use of "surpass" or "surpassing" hereinafter may refer to "reach and/or surpass" or "reaching and/or surpassing", respectively. In one or more intermediate stages following the initial classification stage, a decision is made on segments unclassified (non-decisive audio contents) as to being of the first class or the second class, by using either the same or different set of features and/or the same or different set of thresholds as in preceding stages, and by examining the number of features having values above their corresponding thresholds. In a cascading process, in each intermediate stage the measure of certainty related to the classification of the first (second) class is lower than in the preceding stage (for example by using lower thresholds or by choosing weaker features). Reducing the level of certainty increases the number of features with lower measure of certainty, when compared to the preceding stage, so that the number of features having a low measure of certainty related to their classification to the second (first) class is greater or equal to the preceding stage. In a last stage, optimal separation thresholds may be implemented to classify remaining non-decisive segments as either being of the first or the second class. The decision may be taken based on a majority of features having values above or below the thresholds.

In some embodiments of the invention, the audio segment is split into several smaller continuous frames of audio and the classification features computed are obtained through statistical measurements on values obtained for each frame inside the segment. The audio segments may range in length from 1 to 10 seconds, for example 2-6 seconds, and may include a hop size of 25 to 250 msec, for example 100 msec. The frames may range in length from 10 to 100 msec, for example 30 to 50 msec, and may include a hop size of 15 to 25 msec.

In some embodiments of the invention, smoothing may include for example, averaging the classification decision with respect to each segment with past segment decisions so as substantially reduce rapid alternations in the classification due to erroneous decisions. A smoothing technique may include using an exponentially decaying forgetting factor which gives more weights to recent segments. Alternatively, median filtering may be used for the smoothing. Optionally, decisions made in the intermediate stages may be modified by smoothing. The decisions are given by values of certainty having several possible levels, smoothed in time, and then compared to two predetermined thresholds as well as to past decisions to obtain a final decision. The two thresholds may be computed adaptively.

The inventors have performed extensive evaluations on a database of over 35 hours of audio content, of varying types and qualities, including speech, music and combinations of the two classes. The evaluations demonstrated high rates of correct identification and rapid adjustment to alternating speech/music sections.

There is provided, in accordance with an embodiment of the invention, an apparatus for segmenting an input audio signal into audio contents of a first class and of a second class, the apparatus comprising an audio segmentation module adapted to separate said input audio signal into one or more segments of a predetermined length; a feature computation module adapted to calculate for each segment in the one or more segments one or more features characterizing said audio input signal; a threshold comparison module adapted to generate a feature vector for each segment in the one or more segments by comparing the one or more features in each segment with a plurality of predetermined thresholds, the plurality of predetermined thresholds including for each of the audio contents of the first class and of the second class a substantially near certainty threshold, a substantially high certainty threshold, and a substantially low certainty threshold, wherein each threshold of the plurality of thresholds represents a statistical measure relating to the one or more features; and a classification module adapted to analyze the feature vector and classify each segment in the one or more segments as audio contents of the first class, of the second class, or as non-decisive audio contents; wherein a segment is classified as audio contents of the first class when the feature vector includes at least one feature surpassing the substantially near certainty threshold of the first class and no features surpassing the substantially near certainty and the substantially high certainty thresholds of the second class; wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second class; and wherein the classification module is further adapted to, at a subsequent separation classifications stage, classify segments of non-decisive audio contents into audio contents of the first class or of the second class. Optionally, a segment is classified as audio contents of the first class when the feature vector includes at least two features surpassing the substantially near certainty threshold of the first class and no features surpassing the substantially near certainty threshold of the second class. Optionally, a segment is classified as audio contents of the second class when the feature vector includes at least two features surpassing the substantially near certainty threshold of the second class and no features surpassing the substantially near certainty threshold of the first class. Additionally or alternatively, classifying segments in the intermediate classification stages include cascading a threshold between subsequent stages.

In some embodiments of the invention, the classification module is adapted to implement two or more intermediate classifications stages, and wherein classifying segments in the intermediate classification stages includes cascading one or more thresholds between subsequent intermediate classifications stages. Optionally, classifying segments in the intermediate classification stages includes cascading between subsequent intermediate classifications stages the number of features in the feature vector that are required to surpass the substantially high certainty threshold of the first class in order for a non-decisive segment to be classified as audio contents of the first class.

In some embodiments of the invention, the apparatus further comprises an audio framer module adapted to separate each segment in the one or more segments into frames of a predetermined length. Optionally, the predetermined length of each frame ranges from 10-100 msec. Optionally, the predetermined length of each frame ranges from 30-50 msec. Additionally or alternatively, a hop size of each frame is 5-50 msec. Optionally, a hop size of each frame is 15-25 msec.

There is provided, in accordance with an embodiment of the invention, a method for segmenting an input audio signal into audio contents of a first class and of a second class, the method comprising separating said input audio signal into one or more segments of a predetermined length; calculating for each segment in the one or more segments one or more features characterizing said audio input signal; generating a feature vector for each segment in the one or more segments by comparing the one or more features in each segment with a plurality of predetermined thresholds, the plurality of predetermined thresholds including for each of the audio contents of the first class and of the second class a substantially near certainty threshold, a substantially high certainty threshold, and a substantially low certainty threshold, wherein each threshold of the plurality of thresholds represents a statistical measure relating to the one or more features; and analyzing the feature vector and classifying each segment in the one or more segments as audio contents of the first class, of the second class, or as non-decisive audio contents; wherein a segment is classified as audio contents of the first class when the feature vector includes at least one feature surpassing the substantially near certainty threshold of the first class and no features surpassing the substantially near certainty and the substantially high certainty thresholds of the second class; wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second class; and wherein the classification module is further adapted to, at a subsequent separation classifications stage, classify segments of non-decisive audio contents into audio contents of the first class or of the second class. Optionally, the method further comprises classifying a segment as audio contents of the first class when the feature vector includes at least two features surpassing the substantially near certainty threshold of the first class and no features surpassing the substantially near certainty class of the second class. Optionally, the method further comprises classifying a segment as audio contents of the second class when the feature vector includes at least two features surpassing the substantially near certainty threshold of the second class and no features surpassing the substantially near certainty threshold of the first class. Additionally or alternatively, the method further comprises cascading a threshold between subsequent stages in the intermediate classification stages.

In some embodiments of the invention, the method further comprises implementing two or more intermediate classifications stages, and wherein classifying segments in the intermediate classification stages includes cascading one or more thresholds between subsequent intermediate classifications stages. Optionally, classifying segments in the intermediate classification stages includes cascading between subsequent intermediate classifications stages the number of features in the feature vector that are required to surpass the substantially high certainty threshold of the first class in order for a non-decisive segment to be classified as audio contents of the first class.

In some embodiments of the invention, the method further comprises separating each segment in the one or more segments into frames of a predetermined length. Optionally, the predetermined length of each frame ranges from 10-100 msec. Optionally, the predetermined length of each frame ranges from 30-50 msec. Additionally or alternatively, a hop size for each frame of 5-50 msec. Optionally, a hop size for each frame of 15-25 msec.

There is provided, in accordance with an embodiment of the invention, a system for segmenting audio content into a first class and a second class, the system comprising an apparatus for segmenting an input audio signal into audio contents of a first class and of a second class, the apparatus comprising an audio segmentation module adapted to separate said input audio signal into one or more segments of a predetermined length; a feature computation module adapted to calculate for each segment in the one or more segments one or more features characterizing said audio input signal; a threshold comparison module adapted to generate a feature vector for each segment in the one or more segments by comparing the one or more features in each segment with a plurality of predetermined thresholds, the plurality of predetermined thresholds including for each of the audio contents of the first class and of the second class a substantially near certainty threshold, a substantially high certainty, and a substantially low certainty threshold, wherein each threshold of the plurality of thresholds represents a statistical measure relating to the one or more features; and a classification module adapted to analyze the feature vector and classify each segment in the one or more segments as audio contents of the first class, of the second class, or as non-decisive audio contents; wherein a segment is classified as audio contents of the first class when the feature vector includes at least one feature surpassing the substantially near certainty threshold of the first class and no features surpassing the substantially near certainty and the substantially high certainty thresholds of the second class;

wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second class; and wherein the classification module is further adapted to, at a subsequent separation classifications stage, classify segments of non-decisive audio contents into audio contents of the first class or of the second class; an audio interface unit for transferring the input audio signal from an audio source to the apparatus; and a processing unit for processing the audio content classified into the first class and the second class.

In some embodiments of the invention, for each segment of the one or more segments said classification yields a numerical measure of certainty with respect to being either a first or a second type of audio content, where the numerical measure is a number between a first low extreme value and a second high extreme value, wherein the high extreme value is a high indication of the first type and wherein the low extreme value is a high indication of the second type, and wherein numerical measure values in between the extremes indicate each type with certainty related to the absolute difference between the value and each the extreme. Optionally, for each segment of the one or more segments the numerical measure is additionally smoothed using a smoothing filter in time, wherein the sequence of the numerical measures for the one or more segments is used as an input signal to the filter, and wherein the final classification decision for each segment is given by obtaining two thresholds for final classification; if the output value on a segment of the smoothing filter is greater than first of the thresholds then first the type is concluded; otherwise if the output value on the segment of the smoothing filter is smaller than second of the thresholds then the second type is concluded; otherwise the decision is taken with respect to a well-defined function on the history of past decisions, e.g. the direction in time of the output signal of the smoothing filter, wherein upward numerical direction results in conclusion of the first type and wherein downward numerical direction results in conclusion of the second type.

In some embodiments of the invention, the audio content of the second class is speech. Optionally, the audio content of the first class are music, environmental sound, silence, or any combination thereof.

In some embodiments of the invention, the one or more features include short-time energy, zero-crossing rate, band energy ratio, autocorrelation coefficient, Mel frequency cepstrum coefficients, spectrum roll-off point, spectrum centroid, spectral flux, spectrum spread, or any combination thereof.

In some embodiments of the invention, the predetermined length of each segment in the one or more segments ranges from 1-10 sec. optionally, the predetermined length of each segment in the one or more segments ranges from 2-6 sec.

BRIEF DESCRIPTION OF FIGURES

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. The description taken with the drawings making apparent to those skilled in the art how the several forms of the invention may be embodied in practice.

DETAILED DESCRIPTION

Figure 1:
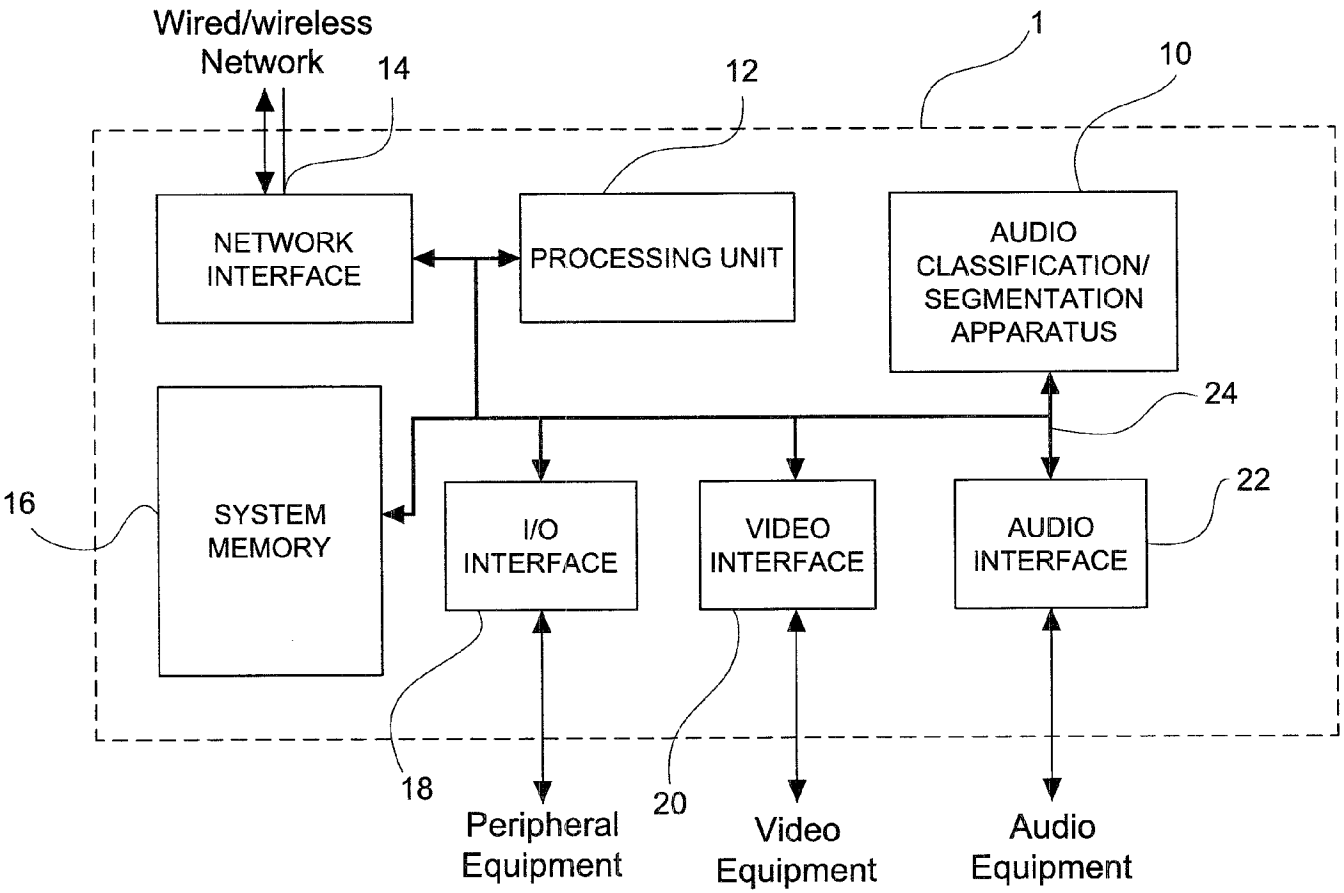
FIG. 1 schematically illustrates a simplified audio content classification and segmentation system according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Unless specifically stated otherwise, as apparent from the following discussions, it is appreciated that throughout the specification discussions utilizing terms such as "processing", "translating", "calculating", "determining", "generating", "reading" or the like, refer to the action and/or processes of a computer that manipulate and/or transform data into other data, said data represented as physical, such as electronic, quantities and are representing the physical objects. The term "computer" should be expansively construed to cover any kind of electronic device with data processing capabilities, including, by way of non-limiting example, personal computers, servers, computing systems, communication devices, storage devices, processors (e.g. digital signal processor (DSP), microcontrollers, field programmable gate array (FPGA), application specific integrated circuits (ASIC), and the like.) and other electronic computing devices.

The operations in accordance with the teachings herein may be performed by a computer specially constructed for the desired purposes or by a general purpose computer specially configured for the desired purpose by a computer program stored in a computer readable storage medium.

Embodiments of the present invention are not described with reference to any particular programming language. It will be appreciated that a variety of programming languages may be used to implement the teachings of the inventions as described herein.

Glossary

Provided below is a list of conventional terms. For each of the terms below a short definition is provided in accordance with each of the term's conventional meaning in the art. The terms provided below are known in the art and the following definitions are provided for convenience purposes only. Accordingly, unless stated otherwise, the definitions below shall not be binding and the following terms should be construed in accordance with their usual and acceptable meaning in the art:

Feature

A variable measured or computed from a sampled audio signal and aimed at characterizing it. A feature is often computed from short signal sections, either directly from the waveform, or from some transformations of it, in order to represent the local variations of the audio signal.

Threshold

A numerical value relating to a feature for separating the range of possible values of the feature into two, those smaller (or equal) than the threshold value and those greater (or equal to) than the threshold value.

Class

A label given to an item (in the context of audio—to an audio signal segment), describing its association with a group of items sharing some similar characteristic(s) (in the context of audio—to a group of items of a similar audio content in some aspect).

Classification

The process of assigning a unique class to each item provided.

Certainty of Classification

The estimated probability of a classification process being correct, achieved through statistical analysis.

Segmentation

Classification of each of several segments of audio, thus splitting a continuous audio signal into continuous parts that are identified as being associated with a common class.

Short-Time Energy

The short-time energy of a frame is defined as the sum of squares of the signal samples, normalized by the frame length and converted to decibels:

$$E = 10\log_{10}\left(\frac{1}{N}\sum_{n=0}^{N-1} x^2[n]\right)$$

Zero-Crossing Rate

The zero-crossing rate of a frame is defined as the number of times the audio waveform changes its sign in the duration of the frame:

$$ZCR = \frac{1}{2}\sum_{n=1}^{N-1} |\mathrm{sgn}(x[n]) - \mathrm{sgn}(x[n-1])|$$

Band Energy Ratio

The band energy ratio captures the distribution of the spectral energy in different frequency bands. The spectral energy in a given band is defined as follows: Let x[n] denote one frame of the audio signal (n=0 . . . N−1), and let X(k) denote the Discrete Fourier Transform (DFT) of x[n]. The values of X(k) for k=0 . . . ⌊K/2⌋−1 correspond to discrete frequency bins from 0 to π, with π indicating half of the sampling rate $F_s$. Let f denote the frequency in Hz. The DFT bin number corresponding to f is given by:

$$\hat{f} = \left\lfloor \frac{f}{F_s} \cdot K \right\rfloor$$

For a given frequency band $[f_L, f_H]$ the total spectral energy in the band is given by:

$$E_{f_L,f_H} = \sum_{k=\hat{f}_L}^{\hat{f}_H} |X(k)|^2$$

Finally, if the spectral energies of the two bands $B_1=[f_L^1, f_H^1]$ and $B_2=[f_L^2, f_H^2]$ are denoted $E_{B_1}$ and $E_{B_2}$ respectively, the ratio is computed on a logarithmic scale, as follows:

$$E_{ratio} = 10\log_{10}\left(\frac{E_{B_1}}{E_{B_2}}\right)$$

By way of example two features based on band energy ratio were used—the low energy ratio, defined as the ratio between the spectral energy below for example 100-150 Hz and the total energy, and the high energy ratio, defined as the ratio between the energy above 10-14 KHz and the total energy, where the sampling frequency is 44 KHz. Optionally, other ranges may be used.

Autocorrelation Coefficient

The autocorrelation coefficient is defined as the highest peak in the short-time autocorrelation sequence, and is used to evaluate how close the audio signal is to a periodic one. First, the normalized autocorrelation sequence of the frame is computed:

$$\hat{A}(m) = \frac{A(m)}{A(0)} = \frac{\sum_{n=0}^{N-m-1} x[n]x[n+m]}{\sum_{n=0}^{N-1} (x[n])^2}$$

Next, the highest peak of the autocorrelation sequence between $m_1$ and $m_2$ is located, where $m_1$ and $m_2$ correspond to periods between, for example period between 2.5 ms and 16 ms (which is the expected fundamental frequency range in voiced speech). The autocorrelation coefficient is defined as the value of the following peak:

$$\mathrm{AC} = \max_{m=m_1 \ldots m_2} \{\hat{A}(m)\}$$

Mel Frequency Cepstrum Coefficients

The Mel Frequency Cepstrum Coefficients (MFCC) are known to be a compact and efficient representation of speech data [3, 4]. The MFCC computation starts by taking the DFT of the frame X(k) and multiplying it by a series of triangularly-shaped ideal band-pass filters $V_i(k)$, where the central frequencies and widths of the filters are arranged according to the Mel scale [5]. Next, the total spectral energy contained in each filter is computed:

$$E(i) = \frac{1}{S_i}\sum_{k=L_i}^{U_i} (|X(k)| \cdot V_i(k))^2,$$

where $L_i$ and $U_i$ are the lower and upper bounds of the filter and $S_i$ is a normalization coefficient to compensate for the variable bandwidth of the filters:

$$S_i = \sum_{k=L_i}^{U_i} (V_i(k))^2$$

Finally, the MFCC sequence is obtained by computing the Discrete Cosine Transform (DCT) of the logarithm of the energy sequence E(i):

$$MFCC(l) = \frac{1}{N}\sum_{i=0}^{N-1}\log(E(i))\cdot\cos\left(\frac{2\cdot\pi}{N}\left(i+\frac{1}{2}\right)\cdot l\right)$$

The first K MFC coefficients for each frame were computed. By way of example, K may be 10-15. Each individual MFC coefficient is considered a feature. In addition, the MFCC difference vector between neighboring frames is computed, and the Euclidean norm of that vector is used as an additional feature:

$$\Delta MFCC(i, i-1) = \sqrt{\sum_{l=1}^{K}|MFCC_i(l) - MFCC_{i-1}(l)|^2},$$

where i represents the index of the frame and K is the number of MFC coefficients.

Spectrum Rolloff Point

The spectrum rolloff point [2] is defined as the boundary frequency $f_r$, such that a certain percent p of the spectral energy for a given audio frame is concentrated below $f_r$:

$$\sum_{k=0}^{f_r}|X(k)| = p\cdot\sum_{k=0}^{K-1}|X(k)|$$

In this disclosure p in the range of 70%-90% is used. However, according to some embodiments, other ranges may also be suitable.

Spectrum Centroid

The spectrum centroid, is defined as the center of gravity (COG) of the spectrum for a given audio frame, and is computed as:

$$S_c = \frac{k\cdot\sum_{k=0}^{K-1}|X(k)|}{\sum_{k=0}^{K-1}|X(k)|}$$

Spectral Flux

The spectral flux measures the spectrum fluctuations between two consecutive audio frames. It is defined as:

$$S_f = \sum_{k=0}^{K-1}(|X_m(k)| - |X_{m-1}(k)|)^2$$

namely, the sum of the squared frame-to-frame difference of the DFT magnitudes [2], where m−1 and m are the frame indices.

Spectrum Spread

The spectrum spread [6] is a measure that computes how the spectrum is concentrated around the perceptually adapted audio spectrum centroid, and calculated according to the following:

$$S_{sp} = \sqrt{\frac{\sum_{k=0}^{K-1}([\log_2(f(k)/1000) - ASC]^2\cdot|X(k)|^2)}{\sum_{k=0}^{K-1}|X(k)|^2}},$$

Where f(k) is the frequency associated with each frequency bin, and ASC is the perceptually adapted audio spectral centroid, as in [6], which is defined as:

$$ASC = \frac{\sum_{k=0}^{K-1}\log_2(f(k)/1000)\cdot|X(k)|^2}{\sum_{k=0}^{K-1}|X(k)|^2}$$

Reference is made to FIG. 1 which schematically illustrates a simplified audio content classification and segmentation system 1 according to an embodiment of the invention. System 1 is adapted to process an audio signal and to classify and/or segment audio contents in the signal into audio content of a first class and a second class. In some embodiments of the invention, the first class content may be speech and the second class content may be music. Optionally, the second class content includes environmental sounds and/or silence. Optionally, system 1 is further adapted to classify and/or segment other types of audio contents exclusive to, or in addition to, those previously mentioned. System 1 may be additionally adapted to be used in real-time applications, including for example, consumer audio and/or video involving real-time differential enhancements.

System 1 includes an audio classification/segmentation apparatus 10 adapted to classify and/or segment the audio signal into the audio contents of the first class and the second class; a processing unit 12 adapted to functionally control all units in the system; a network interface unit 14 adapted to connect the system through wired and/or wireless networks to sources of the audio signal; a system memory unit 16 adapted to store all data, or optionally a portion of the data, required for system operation; an input/output (I/O) interface unit 18 adapted to connect the system with peripheral equipment such as printers, external storage devices, keyboards, external processors, and the like; a video interface unit 20 adapted to connect the system to video devices which may serve as sources of the audio signal; an audio interface unit 22 adapted to connect the system to audio devices which may serve as sources of the audio signal; and a bus 24 functionally interconnecting the units in the system. In some embodiments of the invention, processing unit 12 may be included in apparatus 10. In other embodiments of the invention, any one unit included in system 1, or any combination of units included therein, may be included in apparatus 10. Optionally, functional interconnection of all, or optionally some, of the units in system 1 is by other wired and/or wireless means.

In accordance with an embodiment of the invention, apparatus 10 is functionally adapted to receive a digitized input audio signal; divide the signal into a plurality of audio segments; classify each segment using a multi-stage sieve-like approach and apply Bayesian and/or rule based decision methods; and optionally smooth the classification decision for each segment using past segments. Optionally the signal is an analog signal. Apparatus 10 may comprise hardware, combined hardware and software, or firmware, in order to perform these functions, as described in greater detail further on herein. A feature vector is generated for each audio segment from a predefined set of features which include short-time energy, zero-crossing rate, band energy ratio, autocorrelation coefficient, Mel frequency cepstrum coefficients, spectrum roll-off point, spectrum centroid, spectral flux, spectrum spread, or any combination thereof. Optionally, the feature vector is generated for a plurality of audio segments. Optionally, the feature vector is generated for one or more continuous frames making up the segment. The feature vector is compared to thresholds based on predetermined feature values (hereinafter referred to as "feature thresholds" or "thresholds") in order to determine whether a segment is of the first class or the second class.

In accordance with an embodiment of the invention, apparatus 10 is additionally adapted to output a segment-by-segment classification decision of the input audio signal in a binary mode, wherein each segment is classified as class 1 (of the first class) or class 2 (of the second class). Optionally, the output is continuous, defining the measure of certainty with which the segment may be said to belong to either the first class or the second class. Segments classified as of the first class or the second class are output from apparatus 10 and processed by processing unit 12 according to predetermined requirements. In some embodiments the classified contents may be stored in system memory 16 for future use. Optionally, the classified content may be output through I/O interface unit 18 to peripheral equipment for further processing. Additionally or alternatively, the classified content may be output through network interface unit 14, video interface unit 20, audio interface unit 22, or any combination thereof for further processing external to system 1.

The input audio signal may be received from audio equipment connected to system 1 through audio interface 22, the audio equipment comprising any type of device adapted to output an audio signal such as, for example, CD (compact disc) players, portable memory devices (such as flash memory) in which audio is stored, radios, microphones, mobile phones, landline telephones, laptop computers, PCs, and the like. Apparatus 10 may additionally receive the input audio signal from video equipment connected to system 1 through video interface unit 20, the unit optionally adapted to extract the audio signal from a combined video and audio signal received from the video equipment. Examples of video equipment may include devices such as televisions, set-top boxes, play stations, PDAs (personal digital assistants), video cameras, laptop computers, portable video players, home video players, PCs, mobile phones, and the like. Furthermore, apparatus 10 may receive the input audio signal from media received through a wired and/or wireless network connected to system 1 by means of network interface unit 14. The wired network may include, for example, telephone lines, electric lines, CATV, broadband lines, fiber optic, Ethernet, and the like, or any combination thereof. The wireless network may include for example, Wi-Fi (Wireless LAN), WPAN (Wireless personal area network), WiMAX (Broadband Wireless Access), MBWA (Mobile Broadband Wireless Access), WRAN (Wireless Regional Area Network), satellite, LTE (Long Term Evolution), A-LTE (Advanced LTE), cellular, or any combination thereof. The media may include, for example media and multimedia received through the Internet in the form of audio content or combined audio/video content; or as may be received from devices adapted to transmit over wired and/or wireless networks such as PDAs, laptop computers, mobile phones, PCs, and the like. Optionally, network interface unit 14 may be additionally adapted to extract the audio signal from the combined audio/video content.

Figure 2A:
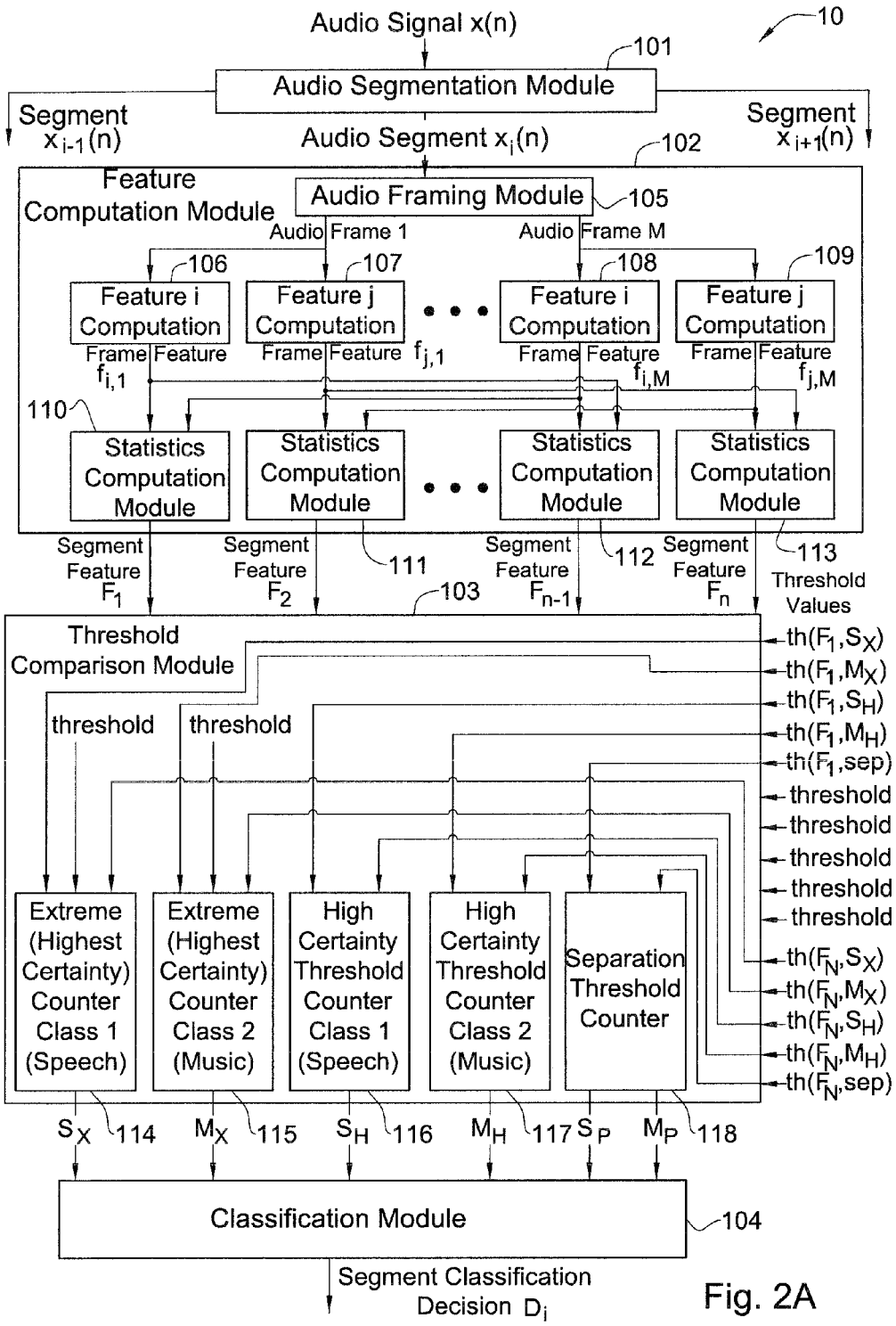
FIGS. 2A and 2B schematically illustrate simplified functional block diagrams of an audio content classification and segmentation apparatus included in FIG. 1, according to an embodiment of the invention.
Figure 2B:
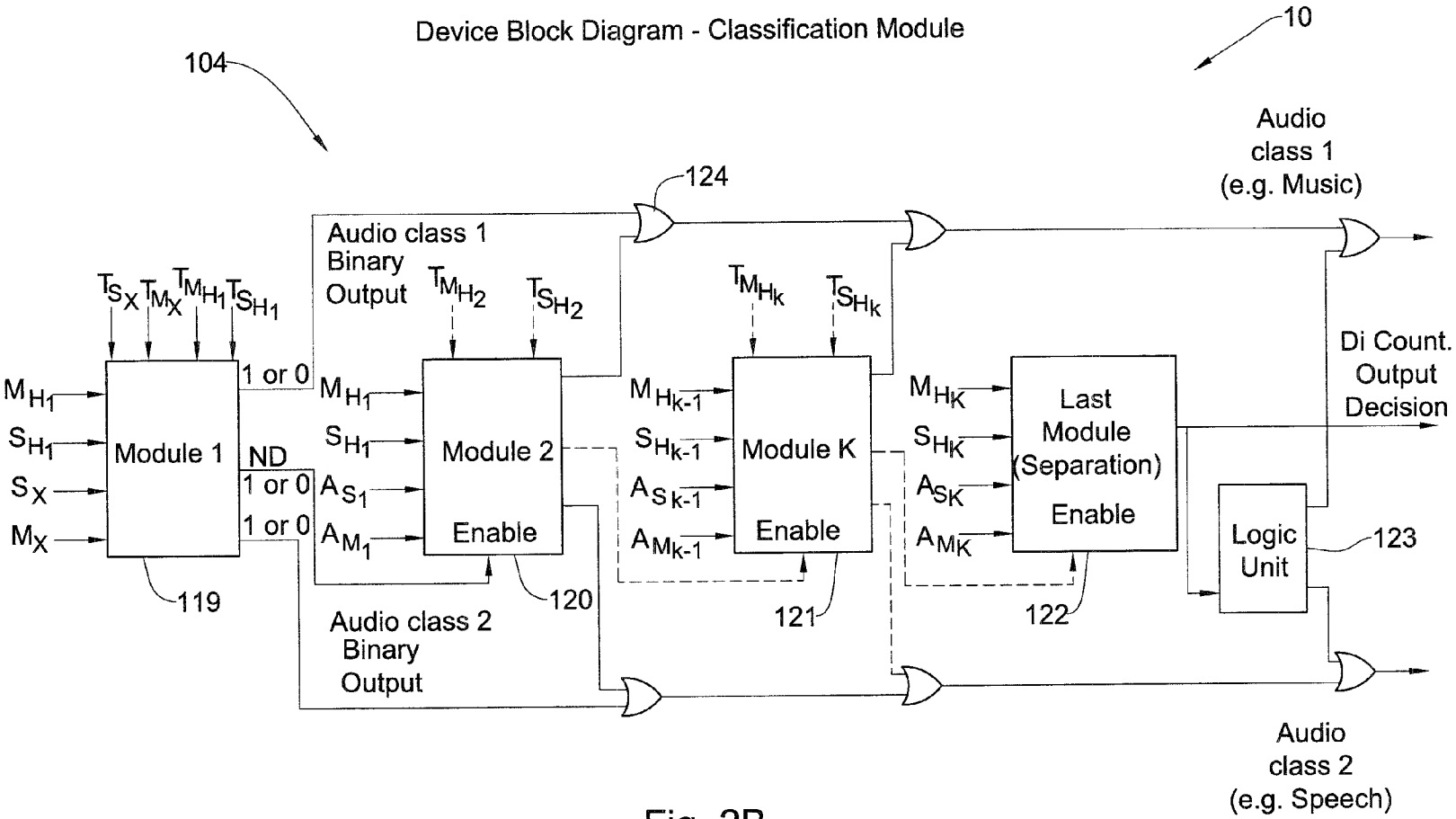

Reference is made to FIGS. 2A and 2B which schematically illustrate simplified functional block diagrams of apparatus 10, according to an embodiment of the invention. Apparatus 10 comprises an audio segmentation module 101, a feature computation module 102, a threshold comparison module 103, and a classification module 104.

Audio segmentation module 101 is adapted to divide the input audio signal into which may include one or more segments, for example a plurality of N segments, each one of the segments to be subsequently classified as class 1 or class 2. The segments may range in length from 1-10 seconds, for example between 2-6 seconds. In order to provide better tracking of changes in the signal, a hop size (which represents the resolution) in the range of 25-250 msec may be used, for example 100 msec.

Feature computation module 102 is adapted to calculate for each segment one or more features which characterize the segment and are used to determine the classification. Each segment is divided by an audio framing module 105 into a plurality of M short frames ranging in length from 10-100 msec, for example, 30-50 msec, and comprising a hop size in the range of 15-25 msec. Optionally, audio framing module 105 may be included in audio segmentation module 101. Optionally, audio framing module 105 may be a stand-alone module within apparatus 10 (external to any other module). Additionally or alternatively, each segment is not divided into the plurality of M frames.

Feature computation sub-modules, as shown by feature computation sub-modules 106, 107, 108 and 109 in feature computation module 102, are adapted to calculate the features for each frame based on a predefined set of features. According to some embodiments of the invention, the predefined set of features is generally selected according to a feature selection method described in Provisional Application No. 61/129,469 referenced earlier herein (see section Cross-Reference to Related Applications). As previously mentioned, the predefined set of features may include short-time energy, zero-crossing rate, band energy ratio, autocorrelation coefficient, Mel frequency cepstrum coefficients, spectrum roll-off point, spectrum centroid, spectral flux, spectrum spread, or any combination thereof. Feature computation sub-modules 106-109 are further adapted to output a numerical (real) feature value for each feature, which may optionally be normalized, and which are then input to a plurality of statistics computation modules, as shown by statistic computation modules 110, 111, 112 and 113, in feature computation module 102.

Statistic computation modules 110, 111, 112 and 113, are adapted to determine a segment-level statistics of the features. According to some embodiments of the invention, the statistical parameters computed include mean value and standard deviation of the feature across the segment, and mean value and standard deviation of the difference magnitude between consecutive analysis points. Optionally, for the zero-crossing rate, the skewness (third central moment, divided by the cube of the standard deviation) and the skewness of the difference magnitude between consecutive analysis frames are also computed. Optionally, with respect to energy the low short time energy ratio (LSTER) is measured. By way of example, the LSTER is defined as the percentage of frames within the segment whose energy level is below one third of the average energy level across the segment. Statistic computation modules 110-113 are further adapted to output segment-level features, one feature per module.

Figure 3:
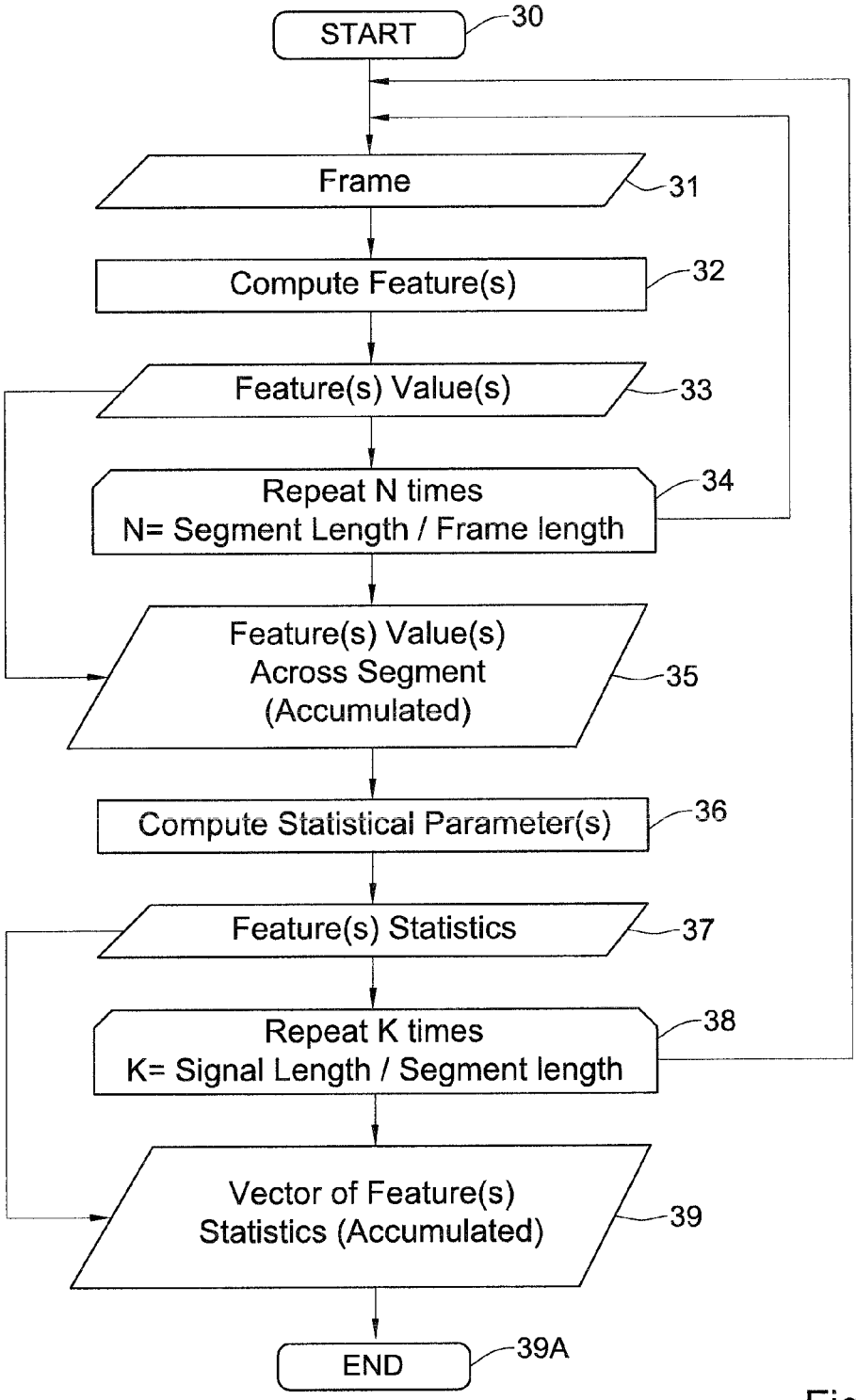
FIG. 3 schematically illustrates a flow diagram of an operation algorithm for a feature computation module included in the apparatus of FIGS. 2A and 2B, according to an embodiment of the invention.

Reference is also made to FIG. 3 which schematically illustrates a flow diagram of an operation algorithm for feature computation module 102, according to an embodiment of the invention. In FIG. 3 and in accordance with some embodiments of the invention, there is provided a description of one possible implementation of a proposed algorithm. A person skilled in the art may readily appreciate that the algorithm illustrated may be otherwise implemented, and further embodiments of the invention contemplate other implementations of the algorithm disclosed herein. In still further embodiments, the implementation of the algorithm is not intended to be limiting in any way, form, or manner.

[Step 30] Feature computation module 102 receives in audio framing module 105 a segment from audio segmentation module 101.

[Step 31] An optional audio framing module 105 divides the segment into a plurality of N frames. Each frame may include a length and a hop size of, for example, 30-50 msec, and 15-25 msec, respectively. A frame is sent to feature computation sub-modules 106-109. The use of frames is optional, and in some embodiments, the method may be carried out directly at the segment level.

[Step 32] Feature computation sub-modules 106-109 calculate the features for a frame according to a predefined set of features. For example, the predefined set of features for classifying speech and music may include the following features: $9^{th}$ MFCC (mean value of difference magnitude), $9^{th}$ MFCC (std. deviation of difference magnitude), $7^{th}$ MFCC (mean value of difference magnitude), $7^{th}$ MFCC (std. deviation of difference magnitude), $4^{th}$ MFCC (std. deviation), energy (std. deviation), energy (mean value of difference magnitude), energy (std. deviation of difference magnitude), high band energy ratio (mean value), spectral roll-off point (mean value), spectral centroid (mean value), LSTER, autocorrelation (std. deviation), autocorrelation (std. deviation of difference magnitude), ZCR (skewness), and ZCR (skewness of difference magnitude). Optionally, all features in a frame are calculated by one feature computation unit, for example, feature computation unit 106.

[Step 33] Feature computation sub-modules 106-109 output a numerical (real) feature value computed for each feature, which may optionally be normalized, in a frame. If feature values have been determined for all features in all frames in the segment go to Step 35. Otherwise, continue to Step 34.

[Step 34] Repeat steps 31 to 33 N times until feature values are determined for all the features in all the frames.

[Step 35] The feature values for all features in all the frames are accumulated for the segment.

[Step 36] Statistic computation modules 110, 111, 112 and 113, determine the segment-level statistics of each feature across the segment. The statistical parameters include mean value and standard deviation of the feature across the segment, and mean value and standard deviation of the difference magnitude between consecutive analysis points. Optionally, for the zero-crossing rate, the skewness and the skewness of the difference magnitude between consecutive analysis frames are also computed. Optionally, with respect to energy the low short time energy ratio (LSTER) is measured.

[Step 37] Statistic computation modules 110-113 calculate all the segment-level features for the segment, one feature per module. If all segment-level features in each segment have been calculated go to Step 39. Otherwise, continue to Step 38.

[Step 38] Repeat steps 31 through 37 for each segment in the audio signal.

[Step 39] Feature computation module 102 accumulates all segment-level features for each segment (for each segment there is a set of segment-level features). According to some embodiments, the segment-level features may include features corresponding to the predefined set of features, for example, as those detailed in Step 32.

[Step 39A] Feature computation module 102 outputs a set of segment-level features for each segment to the threshold comparison module 103.

Threshold comparison module 103 is adapted to generate a feature vector for each segment in the audio signal by comparing the set of segment-level features received from feature computation module 102 with predetermined feature thresholds corresponding to the set. For each segment, threshold comparison module 103 counts the segment-level features that surpass their corresponding thresholds in several different threshold categories. In some embodiments, the thresholds, for example comprising 5 for each feature, are based on statistical measures, for example, probability density functions (PDF) estimated for each feature from varied audio content types accumulated over a period of time. One example of a process for determining the thresholds which may be used in conjunctions with the classification sequence described herein is described in Provisional Application No. 61/129,469 referenced earlier herein and incorporated by reference. However, further embodiments of the invention are not limited to the process described in Provisional Application No. 61/129,469 as the source (or the only source) of thresholds and the thresholds may be obtained from other sources, including but not limited to manual input. Optionally, the thresholds may be heuristically determined. Optionally, the thresholds may be non-statistically determined. Additionally or alternatively, the thresholds may include more than five thresholds per feature. Optionally, the thresholds may include less than five thresholds per feature.

The threshold categories include a substantially near certain threshold for the first class (Tsx) and a substantially near certain threshold for the second class (Tmx), indicative of a measure of certainty of essentially 100% when a feature reaches or exceeds one of the thresholds; a substantially high certainty threshold for the first class (Tsh1) and a substantially high certainty threshold for the second class (Tmh1), indicative of a measure of certainty of a high probability (for example, in the range 37%-100%, 50%-100%, 65%-100%) when a feature reaches or exceeds one of the thresholds; and a substantially low certainty threshold (Tl) for both the first class and the second class, indicative of a measure of certainty of a low probability (for example, less than 37%, less than 50%, less than 65%) for features below the substantially high certainty thresholds. Optionally, there may be more than one level of substantially high certainty threshold for each class, for example, ranging from a second level to a kth level, Tsh2, Tsh3 . . . Tshk for the first class, and Tmh2, Tmh3 . . . Tmhk for the second class. Any different two high certainty thresholds may relate to the same feature(s) or to different feature(s).

Figure 4:
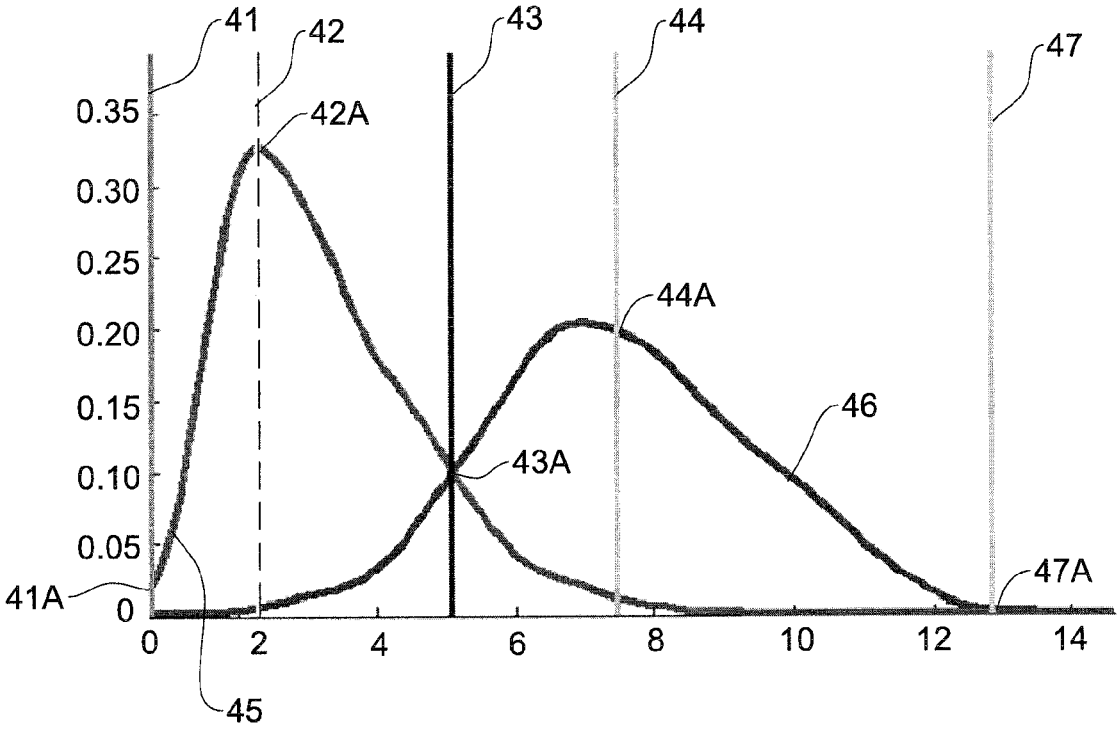
FIG. 4 schematically illustrates PDFs curves for a LSTER (std. deviation) feature in music and speech, according to some embodiments of the invention.
Figure 5A:
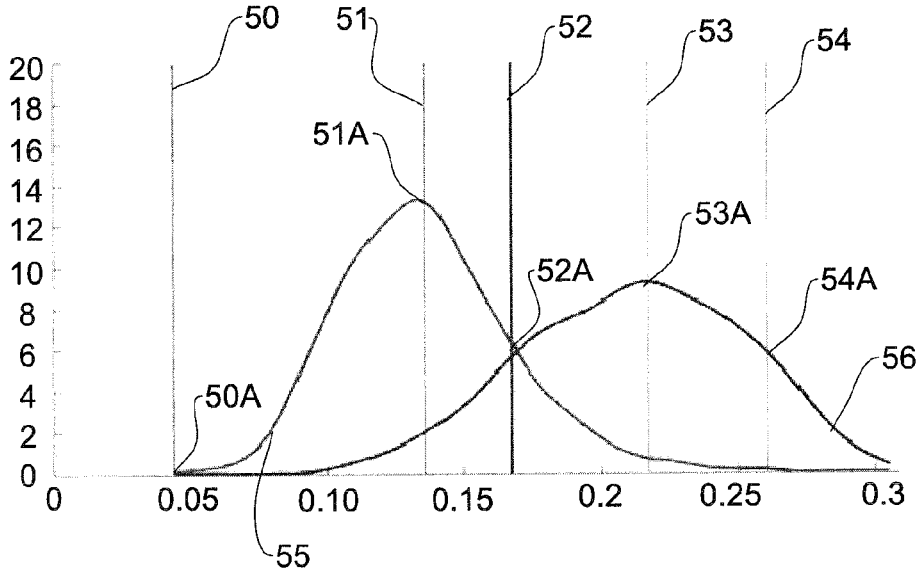
FIG. 5A schematically illustrates PDFs curves for an autocorrelation (std. deviation) feature in music and speech, according to some embodiments of the invention.
Figure 5B:
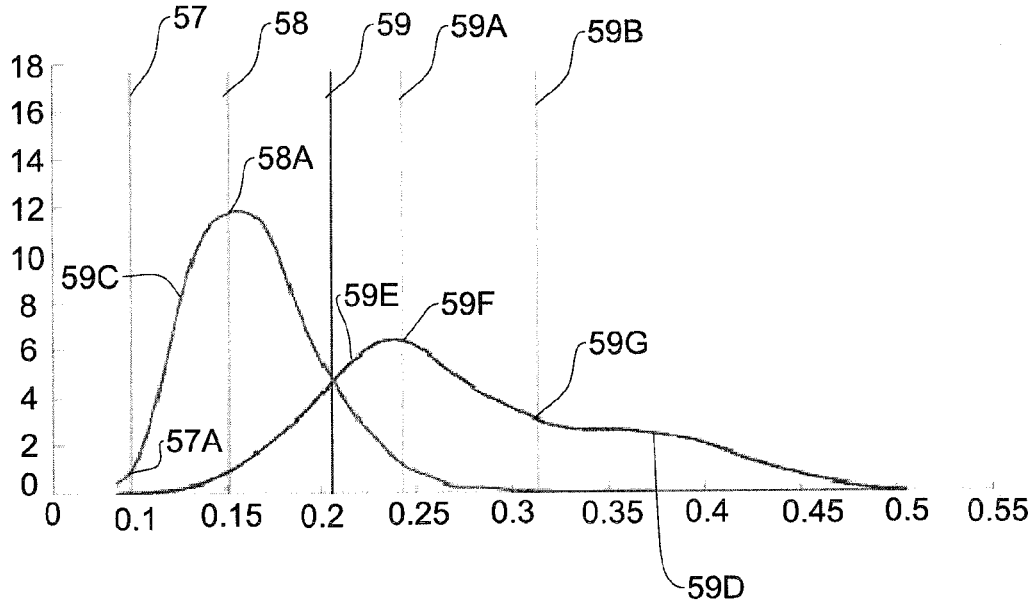
FIG. 5B schematically illustrates PDFs curves for a $9^{th}$ MFCC (mean value of the difference magnitude) feature in music and speech, according to some embodiments of the invention.

Reference is also made to FIG. 4 which schematically illustrates examples of PDFs curves for an LSTER (std. deviation) feature in music and speech, to FIG. 5A which schematically illustrates examples of PDFs curves for an autocorrelation (std. deviation) feature in music and speech, and to FIG. 5B which schematically illustrates examples of PDFs curves for a $9^{th}$ MFCC (mean value of the difference magnitude) feature in music and speech, according to some embodiments of the invention. The PDF curves shown were determined by the method described in Provisional Application No. 61/129,469 referenced earlier herein, the figures further illustrating the substantially near certainty thresholds, the substantially high certainty thresholds, and the substantially low thresholds for music and speech. In some embodiments of the invention, the PDF curves shown in the three figures are generated from same samples of music and speech. Optionally, the curves are generated from different samples of music and speech.

In FIG. 4, the substantially near certainty threshold, the substantially high certainty threshold, and the substantially low threshold for music are shown at intersections of music PDF curve 45 with vertical axes 41, 42 and 43 respectively, and indicated by intersections 41A, 42A and 43A, respectively. The substantially near certainty threshold, the substantially high certainty threshold, and the substantially low threshold for speech are shown at intersections of speech PDF curve 46 with vertical axes 47, 44 and 43 respectively, and indicated by intersections 47A, 44A and 43A, respectively.

In FIG. 5A, the substantially near certainty threshold, the substantially high certainty threshold, and the substantially low threshold for music are shown at intersections of music PDF curve 55 with vertical axes 50, 51 and 52 respectively, and indicated by intersections 50A, 51A and 52A, respectively. The substantially near certainty threshold, the substantially high certainty threshold, and the substantially low threshold for speech are shown at intersections of speech PDF curve 56 with vertical axes 54, 53 and 52A respectively, and indicated by intersections 54A, 53A and 52A, respectively.

In FIG. 5B, the substantially near certainty threshold, the substantially high certainty threshold, and the substantially low threshold for music are shown at intersections of music PDF curve 59C with vertical axes 57, 58 and 59 respectively, and indicated by intersections 57A, 58A and 59E, respectively. The substantially near certainty threshold, the substantially high certainty threshold, and the substantially low threshold for speech are shown at intersections of speech PDF curve 59D with vertical axes 59B, 59A and 59 respectively, and indicated by intersections 59G, 59F and 59E, respectively.

Threshold comparison module 103 includes a threshold counter for each predetermined feature threshold, as shown by threshold counters 114, 115, 116, 117 and 118, each threshold counter adapted to compare the set of segment-level features of each segment with the predetermined feature threshold (threshold value) assigned to the counter, and to count the number of features which reach and/or surpass the threshold value of the counter. For example, as shown, counter 114 is adapted to compare each set of segment-level features with the substantially near certainty threshold for the first class; counter 115 is adapted to compare each set of segment-level features with the substantially near certainty threshold for the second class; counter 116 is adapted to compare each set of segment-level features with the substantially high certainty threshold for the first class; counter 117 is adapted to compare each set of segment-level features with the substantially near certainty threshold for the second class; and counter 118 is adapted to compare each set of segment-level features with the substantially low certainty threshold for the first and second class. Counters 114-118 are further adapted to each output a value representing the number of features which surpassed the threshold values in the set of segment-level features, for example, counter 114 outputs a value Sx indicative of the number of features surpassing the substantially near certainty threshold for class 1, counter 115 outputs a value Mx indicative of the number of features surpassing the substantially near certainty threshold for class 2, counter 116 outputs a value Sh indicative of the number of features surpassing the substantially high certainty threshold for class 1, counter 117 outputs a value Mh indicative of the number of features surpassing the substantially high certainty threshold for class 2. Counter 118 outputs a value Sp indicative of the number of features corresponding to the substantially low certainty threshold and which include features whose values are more indicative of class 1, and a second value Mp indicative of the number of features corresponding to the substantially low certainty threshold and which include features whose values are more indicative of class 2, based on a set of separation thresholds. In some embodiments of the invention, counter 118 outputs only one value indicative of the number of features corresponding to the substantially low certainty threshold for both classes 1 and 2. The output values of counters 114-118 are generated as a feature vector for each segment, the feature vector including a set of integer scalars each representing a number of statistical measures of a given segment, which were above their corresponding threshold (and are used as an indication to the identity of the segment as either audio class 1 or audio class 2).

Classification module 104 is adapted to compute, based on the threshold counter values in the feature vector generated by threshold comparison module 103, a numerical value indicating whether a current segment being classified is of the first class or the second class. According to some embodiments of the invention, the segment-by-segment classification decision is in a binary mode, wherein each segment is classified as class 1 (of the first class) or class 2 (of the second class). Optionally, the output is continuous, defining the measure of certainty with which the segment may be said to belong to either the first class or the second class.

Classification module 104 includes a plurality of classification sub-modules, as shown by sub-modules 119, 120, 121, and 122, connected sequentially in stages. Optionally, sub-modules 119-122 may be included in one sub-module. Sub-modules 119-122 are each adapted to receive its own set of inputs corresponding to the statistical measures of the features (in some embodiments from the feature vector), and are further adapted to compare the statistical measures with the predetermined set of feature thresholds so as to indicate the degree of certainty with which the segment can be considered as audio class 1 or audio class 2.

In an embodiment of the invention, in an initial classification stage, sub-module 119 compares the feature vector with the feature thresholds, with respect to those segments for which the measure of certainty related to their classification is indicative of at least one of the features reaching or surpassing the substantially near certainty threshold for the first (second) class, while for all other features the measure of certainty related to their classification is indicative for the class of no features reaching or surpassing the substantially near certainty threshold nor the substantially high certainty threshold of the second (first) class. The classification is carried out with several degrees of descending (cascading) certainty using a sieve-like approach. In one or more intermediate stages following the initial classification stage and which includes sub-modules 120 and 121 (121 being a kth sub-module prior to last sub-module 122), a decision is made on segments unclassified (non-decisive audio contents) as to being of the first class or the second class, by using either the same or different set of features as in preceding stages and a different set of thresholds, for example, Tsh2 and Tmh2, and by examining the number of features having values above their corresponding thresholds. In the cascading process, in each intermediate stage the measure of certainty related to the classification of the first (second) class is lower than in the preceding stage (for example by using lower thresholds, for example, Tshk and Tmhk, or by choosing weaker features). Reducing the level of certainty increases the number of features with lower measure of certainty, when compared to the preceding stage, so that the number of features having a low measure of certainty related to their classification to the second (first) class is greater or equal to the preceding stage. In a last stage, optimal thresholds may be implemented to classify remaining non-decisive segments as either being of the first or the second class. The decision may be taken based on a majority of features having values above or below the thresholds.

According to some embodiments of the invention, sub-modules 119-121 are additionally adapted to generate three possible binary outputs (may be considered a three-dimensional vector). If either a first or a second output of in one of sub-modules 119-121 is a "1" (both outputs cannot be "1" simultaneously), the segment is classified as audio class 1 or as audio class 2, respectively. A third output, which is connected to an "enable" input of the following sub-module in the following stage, is a "0", so that the following sub-nodule is disabled. When both outputs have a value of "0", the third output receives a value of "1", and the next sub-module is enabled. If either the first or the second output of first sub-module 119 is "1", this is an indication of a very high degree of certainty in the classification. Otherwise, next sub-module 120 is enabled. If either the first or the second output of second sub-module 120 is "1", this is an indication of a high degree of certainty in the classification. If none of the classifications of the first k sub-modules (following kth sub-module 121) are decisive (first and second outputs are "0", non-decisive) last sub-module 122 is enabled, and one of the former two binary outputs is obtained. Optionally, the output is a continuous value (continuous). The first and second outputs of sub-modules 119-12*s* are connected to OR gates, for example, OR gate 124, the gates adapted to allow output of audio content of class 1 or class 2 when one or more of sub-modules 120-122 are disabled.

As previously mentioned, sub-module 119 is the first sub-module in classification module 104. Sub-module 119 receives as an input the values of Sx, Mx, Sh and Mh from the feature vector generated by threshold comparison module 103. According to some embodiments of the invention, the four values are compared to Tsx, Tmx, Tsh1, and Tmh1 to check the certainty of the classification of the current segment as audio class 1 or audio class 2.

If $$(S_x > T_{S_{X_1}} \cap M_x < T_{M_{X_1}}) \cup (S_x > T_{S_{X_2}} \cap M_H < T_{M_{H_1}}),$$

there is a very high confidence that the segment is derived from audio class 1 signal, and there may be very few features that could be related to audio class 2. In this case the first binary output receives a value of "1", and the second output a value of "0".

Or, if $$(M_x > T_{M_{X_1}} \cap S_x < T_{S_{X_1}}) \cup (M_x > T_{M_{X_2}} \cap S_H < T_{S_{H_1}}),$$

there is a very high confidence that the segment is derived from audio class 2 signal, and there may be only very few features that could be related to audio class 1. In this case the second binary output receives a value of "1", and the first output a value of "0".

If both first and second outputs have a value of "0", the third output (non-decisive output, ND) receives a value of "1", enabling sub-module 120.

Sub-module 120 receives as an input the values of $S_H$, $M_H$, $|A_S|$, $|A_M|$, wherein $S_H$, $M_H$ are derived from the feature vector generated by threshold comparison module 103. The other two scalars are $A_S$ and $A_M$, are the set of all features used for the substantially high certainty threshold in the process of obtaining the values of $S_H$, $M_H$, respectively. According to some embodiments of the invention, the four values are compared to Tsh2 and Tmh2 to check the certainty of the classification of the current segment as audio class 1 or audio class 2.

If $(S_H > \alpha_1 |A_S| \cap M_H < Th_{M_2})$, there is a high confidence that the segment is derived from audio class 1 signal, while only few features that could be related to audio class 2. In this case the first binary output receives a value of "1", and the second output a value of "0". According to some embodiments of the invention, $0.5<\alpha 1<1$ and is a real number.

If, on the other hand $(M_H > \alpha_2 |A_M| \cap S_H < Th_{S_2})$, there is a high confidence that the segment is derived from audio class 2 signal, and there may be a few features that could be related to audio class 1. In this case the second binary output receives a value of "1", and the first output is "0". According to some embodiments of the invention, $0.5<\alpha 1<1$ and is a real number.

If both first and second outputs have a value of "0", the ND output receives a value of "1", enabling the following sub-module, for example, sub-module 121.

Sub-module 121 (kth module) receives as an input the values of Shk−1, Mhk−1, |Ask−1| and |Ask−1|, wherein Shk−1, Mhk−1, are derived from the feature vector generated by threshold comparison module 103. The other two scalars are Ask−1 and Ask−1, are the set of all features used for the k−1 substantially high certainty threshold (Tsk−1, Tmk−1) in the process of obtaining the values of Shk−1, Mhk−1, respectively. According to some embodiments of the invention, the four values are compared to Tshk and Tmhk to check the certainty of the classification of the current segment as audio class 1 or audio class 2. The combinatorial logic used in sub-module 121 may be the same as that used in sub-module 120. Optionally, the logic may be different. If the output of sub-module 121 is non-decisive, last sub-module 122 is enabled by the ND output from sub-module 121.

Sub-module 122 is adapted to classify the non-decisive segments according to the substantially low certainty threshold (Tl), as follows:

$$D_i = \frac{M_P - S_P}{|A_P|},$$

Where $A_P$ is the set of features used with the substantially low threshold, and Mp and Sp are derived from the feature vector generated by threshold comparison module 103. Note that $0 \leqq M_P, S_P \leqq |A_P|$ and $M_P + S_P = |A_P|$, so that a received grade, Di, is always between −1 and 1, reflecting a measure of certainty with which the segment can be classified as first class or second class.

Classification module 104 additionally comprises a logic unit 123, the logic unit adapted to facilitate smoothing and/or final classification of the classified non-decisive segments. When the classification of an individual segment is based solely on data collected from that segment (as described above for the non-decisive segments in sub-module 122), erroneous decisions may lead to classification results that alternate more rapidly than normally expected. Optionally, the smoothing may be applied to decisions made in the intermediate stages (sub-modules 120 and 121). Optionally, the smoothing may be applied to decisions made in the initial classification stage (sub-modules 119). According to some embodiments of the invention, an initial decision may be smoothed by a weighted average with, for example, past decisions, using, further by way of example, an exponentially decaying "forgetting factor", which gives more weight to recent segments:

$$D_s(t) = \frac{1}{F}\sum_{k=0}^{K} D_i(t-k)e^{-k/\tau}$$

where K is the length of the averaging period, $\tau$ is the time constant and $F=\Sigma_{k=0}^{K}e^{-k/\tau}$ is the normalizing constant.

According to some embodiments, following the smoothing procedure, discretization of the decision to either a binary decision or to four or more levels, for example (−1, −0.5, 0.5, 1) may be performed. The four or more levels of the decision correspond to the measure of certainty of the classification. The intermediate levels allow representing signals which are difficult to classify firmly as either class 1 or class, for example signals containing music with speech in the background or vice versa. Optionally, further sub-classifications may be readily devised. By way of example, discretization may be performed as follows: a threshold value $0<T<1$ is determined (for example, empirically set to T=0.3 based on the training data). Values above T or below −T are set to 1 or −1, respectively, whereas values between −T and T are handled as follows: in the four-level decision mode the decision level is set to −0.5 or 0.5, according to the sign; in the binary decision mode the decision level is set according to the current trend of $D_s(t)$, i.e., if $D_s(t)$ is on the rise, $D_b(t)=1$ and $D_b(t)-1$ otherwise, where $D_b(t)$ is the binary decision.

According to some embodiments, in order to avoid erroneous transitions in long periods of either music or speech, the threshold may be adapted over time, for example, by letting $T_h(t)$ be the threshold at time t, and $D_b(t)$, $D_b(t-1)$ be the binary decision values of the current and the previous time instants, respectively. The following is received:

$$\text{if } D_b(t)=D_b(t-1)$$

$$\text{then } T_h(t) \Leftarrow \max(M\cdot T_h(t), T_{min})$$

$$\text{else } T_h(t) \Leftarrow T_{init}$$

Where $0<M<1$ is a predefined multiplier, $T_{init}$ is the initial value of the threshold, and $T_{min}$ is a minimal value, which is set so that the threshold will not reach a value of zero. This mechanism may be useful for substantially increasing the likelihood that whenever a prolonged music (or speech) period is processed, the absolute value of the threshold is slowly decreased towards the minimal value. When the decision is changed, the threshold value is reset to $T_{init}$.

Figure 6:
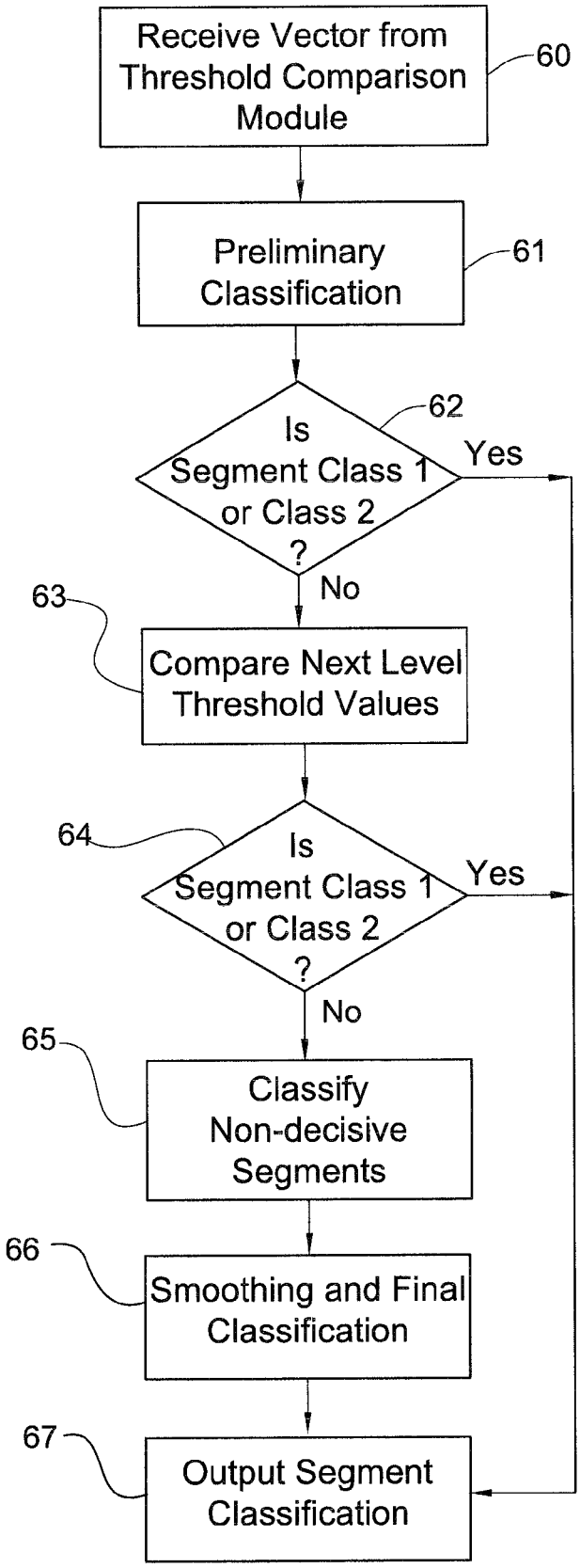
FIG. 6 schematically illustrates a flow diagram of an operation algorithm for a classification module, according to an embodiment of the invention.

Reference is also made to FIG. 6 which schematically illustrates a flow diagram of an operation algorithm for classification module 104, according to an embodiment of the invention. In FIG. 6 and in accordance with some embodiments of the invention, there is provided a description of one possible implementation of a proposed algorithm. A person skilled in the art may readily appreciate that the algorithm illustrated may be otherwise implemented, and further embodiments of the invention contemplate other implementations of the algorithm disclosed herein. In still further embodiments, the implementation of the algorithm is not intended to be limiting in any way, form, or manner.

[Step 60] Classification module 104 receives the feature vector of a segment from threshold comparison module 103. Sub-module 119 receives as an input the scalar values Sx, Mx, Sh and Mb from the feature vector generated by threshold comparison module 103.

[Step 61] Sub-module 119 compares the four scalar values to Tsx, Tmx, Tsh1, and Tmh1 to check the certainty of the classification of the current segment as audio class 1 or audio class 2.

[Step 62] If $$(S_x > T_{S_{X_1}} \cap M_x < T_{M_{X_1}}) \cup (S_x > T_{S_{X_2}} \cap M_H < T_{M_{H_1}})$$

the segment is classified as class 1. If $$(M_x > T_{M_{X_1}} \cap S_x < T_{S_{X_1}}) \cup (M_x > T_{M_{X_2}} \cap S_H < T_{S_{H_1}})$$

the segment is classified as class 2. If the segment is not class 1 or class 2, the segment is classified as non-decisive, and the following sub-module 120 is enabled. Is the segment class 1 or class 2. If yes, go to Step 67. If no, continue to Step 63.

[Step 63] Sub-module 120 receives as an input the values of $S_H$, $M_H$, $|A_S|$, $|A_M|$. The four values are compared to Tsh2 and Tmh2 to check the certainty of the classification of the current segment as audio class 1 or audio class 2.

[Step 64] If $(S_H>\alpha_1|A_S|\cap M_H<Th_{M_2})$ the segment is classified as class 1. If $(M_H>\alpha_2|A_M|\cap S_H<Th_{S_2})$ the segment is classified as class 2. If the segment is not class 1 or class 2, the segment is classified as non-decisive, and the following sub-module 121 is enabled. Is the segment class 1 or class 2. If yes, go to Step 67. If no, repeat this step using a sub-module in the next stage or stages until a decisive classification is reached in one of the sub-modules or until sub-module 121 (kth module) outputs a non-decisive output. For each stage use the scalar values and thresholds as per the description of classification module 104 above. If the output of sub-module 121 is non-decisive, last sub-module 122 is enabled by the ND output from sub-module 121. Go to Step 65.

[Step 65] Sub-module 122 classifies the non-decisive segments according to the substantially low certainty threshold (Tl) and using the scalar values of Sp and Mp. Di for the segment is determined and a decision made regarding the class of the segment.

[Step 66] Logic unit 123 smoothes and/or final classifies the segments classified in sub-module 122. The smoothing is performed using the exponentially decaying "forgetting factor". The final classification is done by discretization of the decision to a binary decision. Optionally, the discretization is to four or more levels.

[Step 67] Classification module 104 outputs the classification of the segment as class 1 or class 2. Optionally, the output is continuous.

Figure 7:
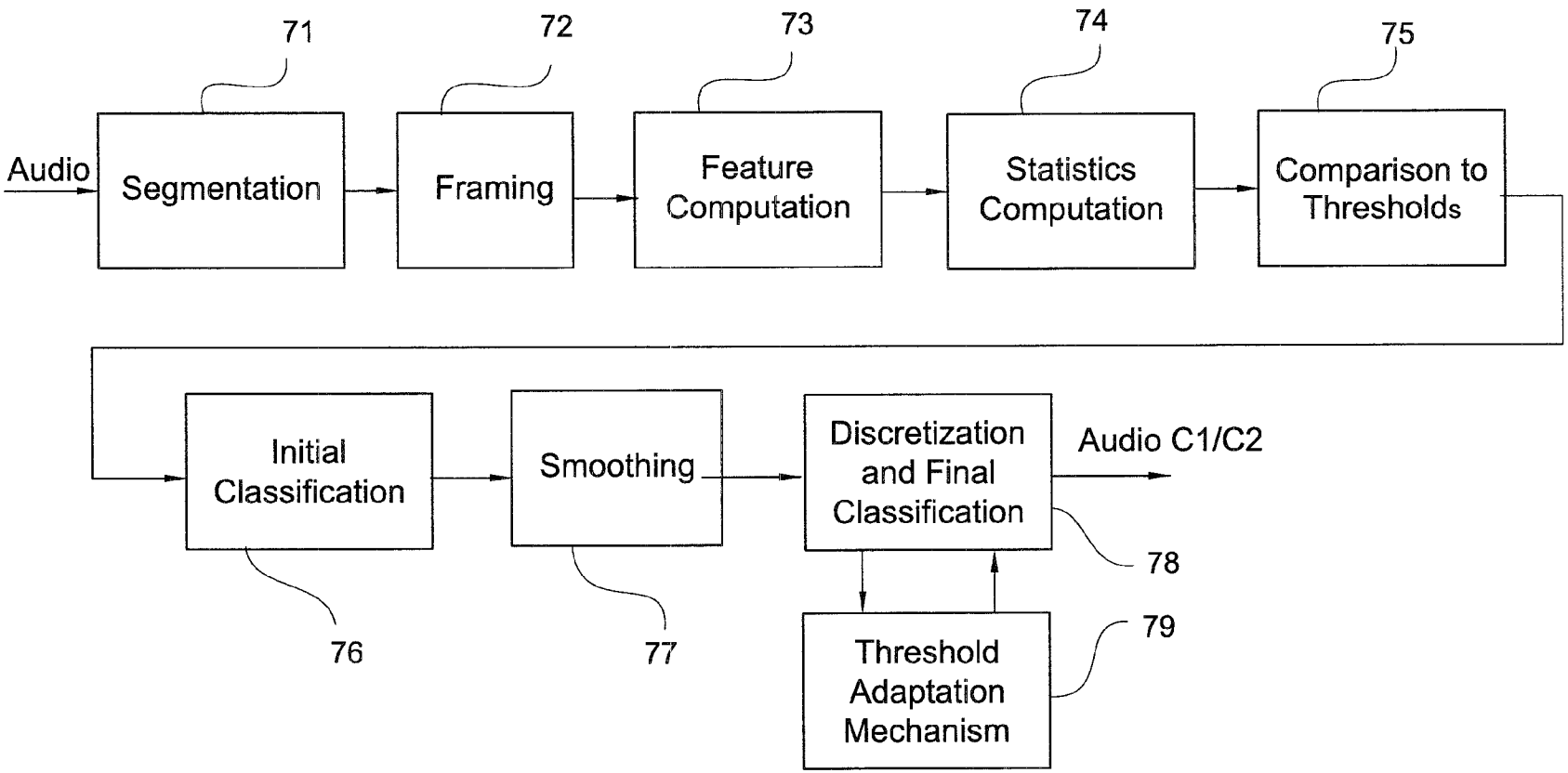
FIG. 7 schematically illustrates a flow diagram of a method for segmenting and/or classifying an audio signal into a first class or a second class, according to an embodiment of the invention.

Reference is made to FIG. 7 which schematically illustrates a flow diagram of a method for segmenting and/or classifying an audio signal into a first class or a second class, according to an embodiment of the invention. Reference is also made to FIGS. 1, 2A, and 2B previously described. In FIG. 7 and in accordance with some embodiments of the invention, there is provided a description of one possible implementation of a proposed algorithm. A person skilled in the art may readily appreciate that the algorithm illustrated may be otherwise implemented, and further embodiments of the invention contemplate other implementations of the algorithm disclosed herein. In still further embodiments, the implementation of the algorithm is not intended to be limiting in any way, form, or manner.

[Step 71] Apparatus 10 receives an input audio signal from an audio source which may include audio equipment, video equipment, or media received through a wireless and/or wired network. The audio signal is segmented into one or more segments which will be subsequently classified as class 1 or class 2 by apparatus 10. The segments may range in length from 1-10 seconds, for example between 2-6 seconds, and may include a hop size in the range of 25-250 msec, for example 100 msec. Segmenting may be done by audio segmentation module 101.

[Step 72] Each segment is divided into a plurality of M short frames ranging in length from 10-100 msec, for example, 30-50 msec, and comprising a hop size in the range of 15-25 msec. Framing may be done by audio framing module 105.

[Step 73] Features are calculated for each frame based on a predefined set of features and output a numerical (real) feature value for each feature, which may optionally be normalized. The predefined set of features may include short-time energy, zero-crossing rate, band energy ratio, autocorrelation coefficient, Mel frequency cepstrum coefficients, spectrum roll-off point, spectrum centroid, spectral flux, spectrum spread, or any combination thereof. Feature computation may be performed by feature computation sub-modules 106, 107, 108 and 109 in feature computation module 102.

[Step 74] Segment-level statistics of the features in each segment are determined. The statistical parameters computed may include mean value and standard deviation of the feature across the segment, and mean value and standard deviation of the difference magnitude between consecutive analysis points. Optionally, for the zero-crossing rate, the skewness (third central moment, divided by the cube of the standard deviation) and the skewness of the difference magnitude between consecutive analysis frames are also computed. Optionally, with respect to energy the low short time energy ratio (LSTER) is measured. By way of example, the LSTER is defined as the percentage of frames within the segment whose energy level is below one third of the average energy level across the segment. The computations may be done by statistic computation modules 110, 111, 112 and 113, in feature computation module 102.

[Step 75] A feature vector for each segment in the audio signal is generated by comparing the set of segment-level features previously computed with predetermined feature thresholds corresponding to the set. For each segment, the segment-level features that surpass their corresponding thresholds in several different threshold categories are counted. The feature vector includes a set of integer scalars each representing a number of statistical measures of a given segment, which were above their corresponding threshold The comparison and the generation of the feature vector may be done by threshold comparison module 103.

[Step 76] A numerical value indicating whether a current segment being classified is of the first class or the second class is computed based on the scalar values in the feature vector, and a comparison with the predetermined set of feature thresholds. Initially compared are those segments for which the measure of certainty related to their classification is indicative of at least one of the features reaching or surpassing the substantially near certainty threshold for the first (second) class, while for all other features the measure of certainty related to their classification is indicative for the class of no features reaching or surpassing the substantially near certainty threshold nor the substantially high certainty threshold of the second (first) class. The classification may be carried out with several degrees of descending (cascading) certainty using a sieve-like approach. According to some embodiments of the invention, a In the cascading process, in each intermediate stage the measure of certainty related to the classification of the first (second) class is lower than in the preceding stage (for example by using lower thresholds, for example, Tshk and Tmhk, or by choosing weaker features). Reducing the level of certainty increases the number of features with lower measure of certainty, when compared to the preceding stage. In a last stage, optimal thresholds may be implemented to classify remaining non-decisive segments as either being of the first or the second class. The decision may be taken based on a majority of features having values above or below the thresholds. The segment-by-segment classification decision may be in a binary mode, wherein each segment is classified as class 1 (of the first class) or class 2 (of the second class). Optionally, the output is continuous, defining the measure of certainty with which the segment may be said to belong to either the first class or the second class. The described above decision process may be performed by classification module 104.

[Step 77] Smoothing of the segments (non-decisive) classified in the last stage of the decision process may include averaging the classification decision with respect to each segment with past segment decisions so as substantially reduce rapid alternations in the classification due to erroneous decisions. A smoothing technique may include using an exponentially decaying forgetting factor which gives more weights to recent segments. Optionally, decisions made in the intermediate stages may be modified by smoothing. Smoothing may be performed by classification module 104.

[Step 78] Following the smoothing procedure, discretization of the decision to either a binary decision or to four or more levels, for example (−1, −0.5, 0.5, 1) may be performed. The four or more levels of the decision correspond to the measure of certainty of the classification. The intermediate levels allow representing signals which are difficult to classify firmly as either class 1 or class 2, for example signals containing music with speech in the background or vice versa. Further sub-classifications may be readily devised. The discretization and final classification may be implemented by the classification module 104.

[Step 79] In order to avoid erroneous transitions in long periods of either music or speech, the threshold may be adapted over time, for example, by letting $T_h(t)$ be the threshold at time t, and $D_b(t)$, $D_b(t-1)$ be the binary decision values of the current and the previous time instants, respectively. This threshold adaptation mechanism may be implemented by the classification module 104.

It is to be understood that the invention is not limited in its application to the details set forth in the description contained herein or illustrated in the drawings. The invention is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the present invention.

It will also be understood that the system according to the invention may be a suitably programmed computer. Likewise, the invention contemplates a computer program being readable by a computer for executing the method of the invention. The invention further contemplates a machine-readable memory tangibly embodying a program of instructions executable by the machine for executing the method of the invention.

Those skilled in the art will readily appreciate that various modifications and changes can be applied to the embodiments of the invention as hereinbefore described without departing from its scope, defined in and by the appended claims.

What is claimed is:

1. An apparatus for classifying an input audio signal into audio contents of a first class and of a second class, the apparatus comprising:

an audio segmentation module adapted to segment said input audio signal into one or more of segments of a predetermined length;

a feature computation module adapted to calculate for each of said one or more segments one or more features characterizing said audio input signal;

a threshold comparison module adapted to generate a feature vector for each of said one or more segments by comparing the one or more features in each segment with a plurality of predetermined thresholds, the plurality of predetermined thresholds including for each of the audio contents of the first class and of the second class a substantially near certainty threshold, a substantially high certainty threshold, and a substantially low certainty threshold, wherein each threshold of the plurality of thresholds represents a statistical measure relating to the one or more features; and a classification module adapted to analyze the feature vector and classify each one of said one or more segments as audio contents of the first class, of the second class, or as non-decisive audio contents; wherein a segment is classified as audio contents of the first class when the feature vector includes at least one feature surpassing the substantially near certainty threshold of the first class and no features surpassing the substantially near certainty threshold and the substantially high certainty threshold of the second class; wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second threshold; and wherein the classification module is further adapted to, at a subsequent separation classifications stage, classify segments of non-decisive audio contents into audio contents of the first class or of the second class.

2. The apparatus according to claim 1, wherein the classification module is further adapted to classify a segment as audio contents of the first class when the feature vector includes at least two features surpassing the substantially near certainty threshold of the first class and no features surpassing the substantially near certainty threshold of the second class.

3. The apparatus according to claim 1, wherein the classification module is adapted to implement two or more intermediate classifications stages, and wherein classifying segments in the intermediate classification stages includes cascading one or more thresholds between subsequent intermediate classifications stages.

4. The apparatus according to claim 1, wherein the classification module is adapted to implement two or more intermediate classifications stages, and wherein classifying segments in the intermediate classification stages includes cascading between subsequent intermediate classifications stages the number of features in the feature vector that are required to surpass the substantially high certainty threshold of the first class in order for a non-decisive segment to be classified as audio contents of the first class.

5. The apparatus according to claim 1 wherein for each segment of the said one or more segments said classification yields a numerical measure of certainty with respect to being either a first or a second type of audio content, where said numerical measure is a number between a first low extreme value and a second high extreme value, wherein the high extreme value is a high indication of first said type and wherein the low extreme value is a high indication of second said type, and wherein numerical measure values in between said extremes indicate each said type with certainty related to the absolute difference between the value and each said extreme.

6. The apparatus according to claim 5 wherein for each segment of the said one or more segments said numerical measure is additionally smoothed using a smoothing filter in time, wherein the sequence of said numerical measures for the said one or more segments is used as an input signal to the filter, and wherein the final classification decision for each segment is given by:

obtaining two thresholds for final classification;

if the output value on a segment of said smoothing filter is greater than first of said thresholds then first said type is concluded;

otherwise if the output value on said segment of said smoothing filter is smaller than second of said thresholds then second said type is concluded;

otherwise the decision is taken with respect to a well-defined function on the history of past decisions, e.g. the direction in time of the output signal of said smoothing filter, wherein upward numerical direction results in conclusion of first said type and wherein downward numerical direction results in conclusion of second said type.

7. The apparatus according to claim 1 wherein the audio contents of the second class is speech.

8. The apparatus according to claim 1 wherein the audio contents of the first class is music, environmental sound, silence, or any combination thereof.

9. The apparatus according to claim 1 further comprising an audio framer module adapted to separate each segment in the one or more segments into frames of a predetermined length.

10. A method for segmenting an input audio signal into audio contents of a first class and of a second class, the method comprising:

separating said input audio signal into one or more of segments of a predetermined length;

calculating for each of said one or more segment one or more features characterizing said audio input signal;

generating a feature vector for each of said one or more segments by comparing the one or more features in each segment with a plurality of predetermined thresholds, the plurality of predetermined thresholds including for each of the audio contents of the first class and of the second class a substantially near certainty threshold, a substantially high certainty threshold, and a substantially low certainty threshold, wherein each threshold of the plurality of thresholds represents a statistical measure relating to the one or more features; and analyzing the feature vector and classifying each one of said one or more segments as audio contents of the first class, of the second class, or as non-decisive audio contents;

wherein a segment is classified as audio contents of the first class when the feature vector includes at least one feature surpassing the substantially near certainty threshold of the first class and no features surpassing the substantially near certainty threshold and the substantially high certainty threshold of the second class; wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second class; and wherein the classification module is further adapted to, at a subsequent separation classifications stage, classify segments of non-decisive audio contents into audio contents of the first class or of the second class.

11. The method according to claim 10 further comprising classifying a segment as audio contents of the first class when the feature vector includes at least two features surpassing the substantially near certainty threshold of the first class and no features surpassing the substantially near certainty threshold of the second class.

12. The method according to claim 10 further comprising implementing two or more intermediate classifications stages, and wherein classifying segments in the intermediate classification stages includes cascading between subsequent intermediate classifications stages the number of features in the feature vector that are required to surpass the substantially high certainty threshold of the first class in order for a non-decisive segment to be classified as audio contents of the first class.

13. The method according to claim 10 wherein for each segment of the said one or more segments said classification yields a numerical measure of certainty with respect to being either a first or a second type of audio content, where said numerical measure is a number between a first low extreme value and a second high extreme value, wherein the high extreme value is a high indication of first said type and wherein the low extreme value is a high indication of second said type, and wherein numerical measure values in between said extremes indicate each said type with certainty related to the absolute difference between the value and each said extreme.

14. The method according to claim 13 wherein for each segment of the said one or more segments said numerical measure is additionally smoothed using a smoothing filter in time, wherein the sequence of said numerical measures for the said one or more segments is used as an input signal to the filter, and wherein the final classification decision for each segment is given by:

obtaining two thresholds for final classification;

if the output value on a segment of said smoothing filter is greater than first of said thresholds then first said type is concluded;

otherwise if the output value on said segment of said smoothing filter is smaller than second of said thresholds then second said type is concluded;

otherwise the decision is taken with respect to a well-defined function on the history of past decisions, e.g. the direction in time of the output signal of said smoothing filter, wherein upward numerical direction results in conclusion of first said type and wherein downward numerical direction results in conclusion of second said type.

15. The method according to claim 10 further comprising implementing two or more intermediate classifications stages, and wherein classifying segments in the intermediate classification stages includes cascading one or more thresholds between subsequent intermediate classifications stages.

16. The method according to claim 10 wherein the audio contents of the second class is speech.

17. The method according to claim 10 wherein the audio contents of the first class is music, environmental sound, silence, or any combination thereof.

18. A system for segmenting audio content into a first class and a second class, the system comprising:

an apparatus for segmenting an input audio signal into audio contents of a first class and of a second class, the apparatus comprising an audio segmentation module adapted to separate said input audio signal into one or more segments of a predetermined length; a feature computation module adapted to calculate for each segment in the said one or more segments one or more features characterizing said audio input signal; a threshold comparison module adapted to generate a feature vector for each segment in the said one or more segments by comparing the one or more features in each segment with a plurality of predetermined thresholds, the plurality of predetermined thresholds including for each of the audio contents of the first class and of the second class a substantially near certainty threshold, a substantially high certainty threshold, and a substantially low certainty threshold, wherein each threshold of the plurality of thresholds represents a statistical measure relating to the one or more features; and a classification module adapted to analyze the feature vector and classify each segment in the said one or more segments as audio contents of the first class, of the second class, or as non-decisive audio contents; wherein a segment is classified as audio contents of the first class when the feature vector includes at least one feature surpassing the substantially near certainty threshold of the first class and no features surpassing the substantially near certainty threshold and the substantially high certainty threshold of the second class; wherein the classification module is further adapted to, at one or more subsequent intermediate classifications stages, to classify a non-decisive segment as audio contents of the first class when a majority of features in the feature vector surpass the substantially high certainty threshold of the first class and no features surpass the substantially high certainty threshold of the second class; and wherein the classification module is further adapted to, at a subsequent separation classifications stage, classify segments of non-decisive audio contents into audio contents of the first class or of the second class;

an audio interface unit for transferring the input audio signal from an audio source to the apparatus; and a processing unit for processing the audio content classified into the first class and the second class.

* * * * *